United States Patent [19]

Bunger et al.

[11] 3,981,612

[45] Sept. 21, 1976

[54] WAVE PRODUCING APPARATUS

[76] Inventors: Charles Bunger; Edward R. Fawess, both of 430 Rutgers Road, North Babylon, N.Y. 11704

[22] Filed: June 27, 1975

[21] Appl. No.: 591,131

[52] U.S. Cl. ..... 416/66; 416/81; 416/83; 61/1 R; 4/172.16

[51] Int. Cl.[2] ..... A47K 3/10

[58] Field of Search ..... 61/1 R; 416/64, 65, 416/66, 81, 83; 4/172.16

[56] References Cited

UNITED STATES PATENTS

| | | | |
|---|---|---|---|
| 1,608,373 | 11/1926 | Dell | 416/66 X |
| 2,161,215 | 6/1939 | Wise | 415/5 |
| 2,752,860 | 7/1956 | Waldin | 416/81 X |
| 3,562,823 | 2/1971 | Koster | 4/172.16 |
| 3,802,697 | 4/1974 | Mehaute | 61/1 R |

*Primary Examiner*—Allen M. Ostrager
*Attorney, Agent, or Firm*—Robert K. Youtie

[57] ABSTRACT

Wave producing apparatus, as for simulated surfing, skateboard riding, and the like, including a flexible elongate web and nether carriage means upwardly flexing the web and movable longitudinally thereof to produce a traveling wave.

7 Claims, 4 Drawing Figures

FIG. 1
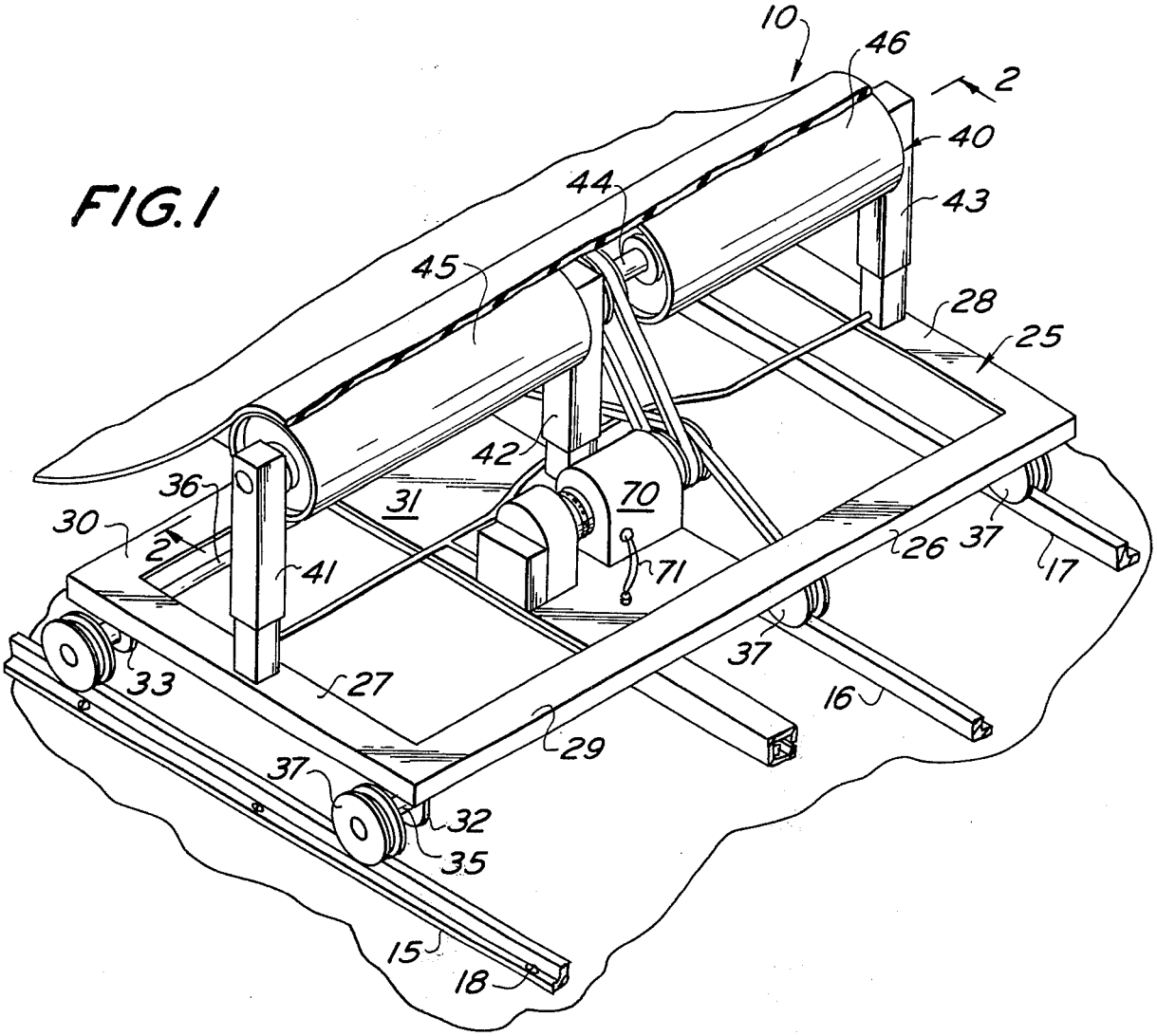
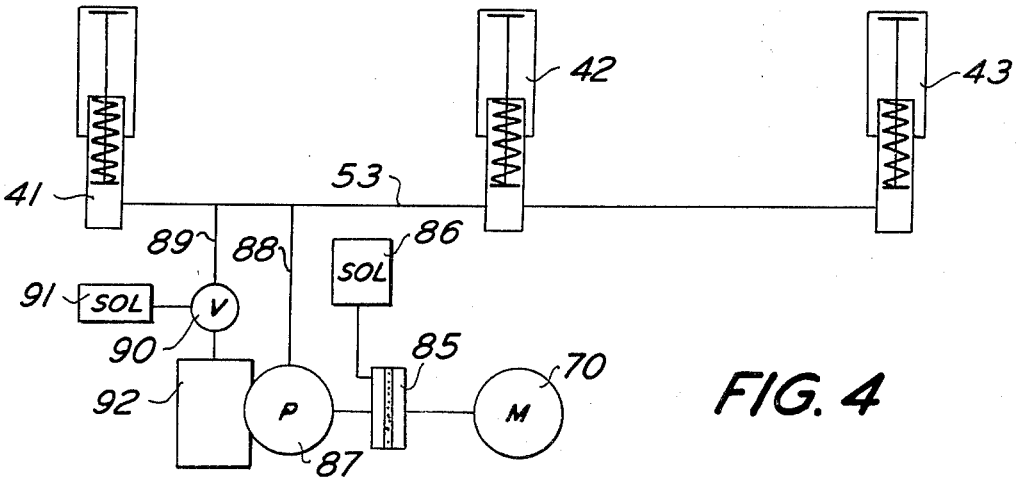
FIG. 4

FIG. 2
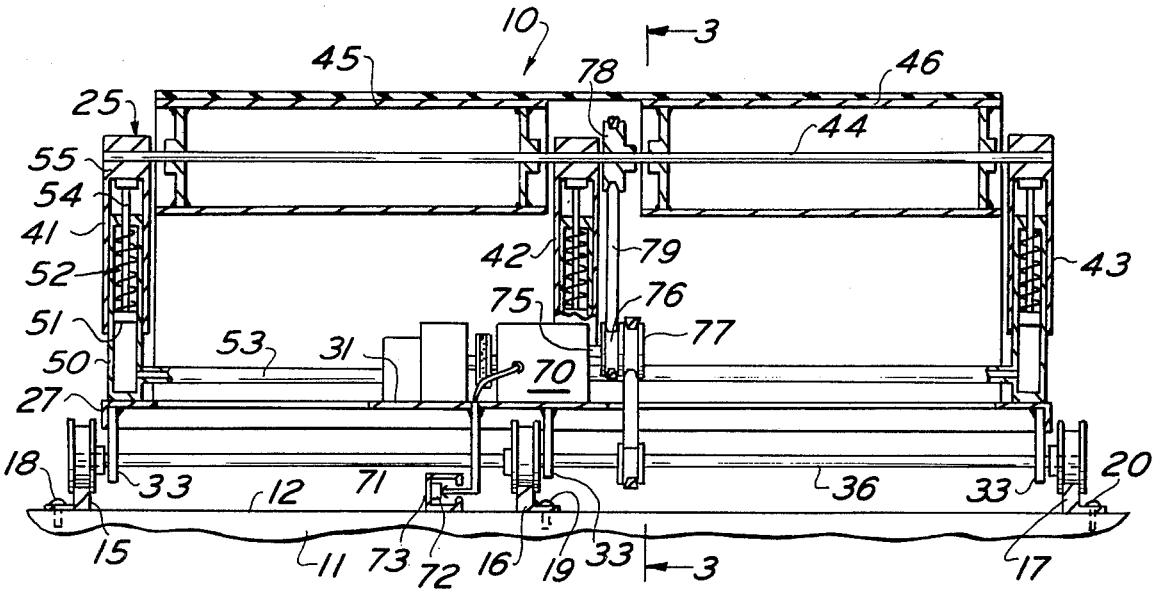
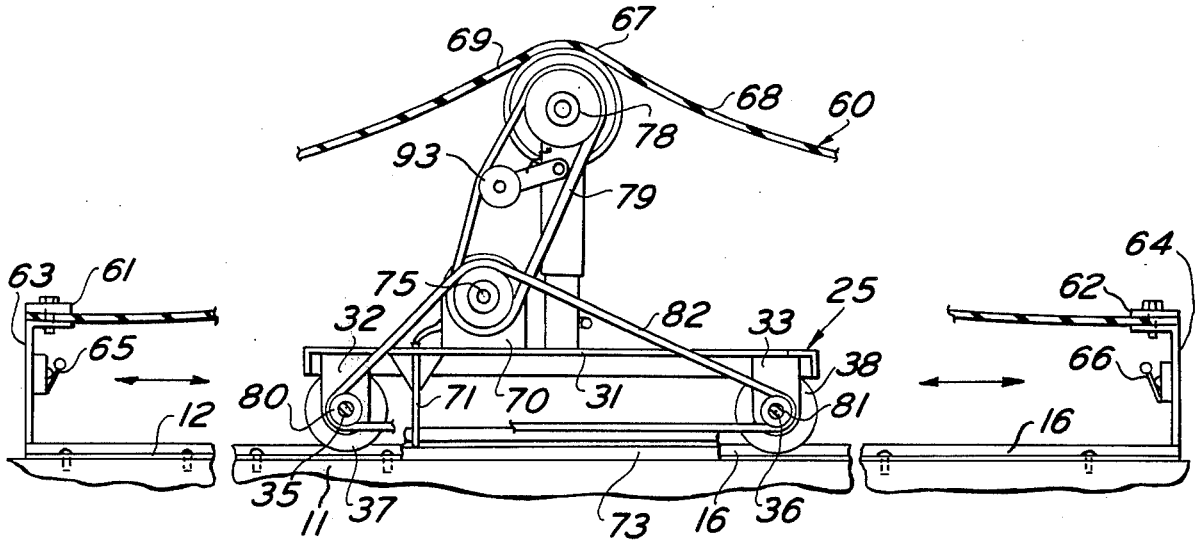
FIG. 3

WAVE PRODUCING APPARATUS

BACKGROUND OF THE INVENTION

While there have, in the past, been proposed devices for producing simulated traveling waves, such devices have not found practical acceptance for many reasons, including those of high cost in manufacture, unreliable operation, and lack of accurate wave simulation.

SUMMARY OF THE INVENTION

It is among the important objects of the present invention to provide a wave producing apparatus which overcomes the above-mentioned difficulties, is extremely simple in construction for economy in manufacture, highly reliable and durable throughout a long useful life, and which simulates with great accuracy a wide variety of traveling wave movements.

It is still a further object of the present invention to provide a wave producing apparatus having the advantageous characteristics mentioned in the preceding paragraph, which is adapted for quick and easy installation, requires minimum of maintenance, and which is adapted for infinite variations in wave production for long continued attraction to users of widely varying abilities and skills.

It is a more particular object of the present invention to provide a traveling wave producing apparatus of the type described which is uniquely well suited for use with skateboards to simulate actual water wave surfing conditions, as well as to create a wide variety of unique and exciting skateboarding conditions.

Other objects of the present invention will become apparent upon reading the following specification and referring to the accompanying drawings, which form a material part of this disclosure.

The invention accordingly consists in the features of construction, combinations of elements, and arrengements of parts, which will be exemplified in the construction hereinafter described, and of which the scope will be indicated by the appended claims.

BRIEF DESCRIPTION OF THE DRAWINGS

FIG. 1 is a partial, top perspective view, partly broken away, showing wave producing apparatus constructed in accordance with the teachings of the present invention.

FIG. 2 is a transverse, sectional elevational view taken generally along the line 2—2 of FIG. 1.

FIG. 3 is a longitudinal sectional elevational view taken generally along the line 3—3 of FIG. 2, broken away to enable use of satisfactory scale.

FIG. 4 is a diagrammatic representation of operating means associated with the instant apparatus.

DESCRIPTION OF THE PREFERRED EMBODIMENT

A wave producing apparatus of the present invention is shown in FIGS. 1–3, and there generally designated 10, including a foundation, base or ground 11 having an upwardly facing, supporting surface 12, seen in FIGS. 2 and 3. This may be any suitable floor or ground surface, interior or exterior, as desired, capable of having secured thereto suitable way means or track for carrying the moving wave producing apparatus.

More specifically, a plurality of parallel rails 15, 16 and 17, such as angle iron, or other suitable elements, may be secured, as by fasteners 18, 19 and 20, respectfully, to the floor or ground surface 12. The angle elements or rails 15–17 combine to define track means or way means for movably supporting a carriage, generally designated 25.

In particular, the carriage 25 may include a generally horizontal, rectangular open frame or chassis 26 extending across and spaced over the track means 15–17. The chassis or frame includes a pair of laterally spaced, side or longitudinal members 27 and 28 generally longitudinally of and over respective rails 15 and 17, and a pair of transversely extending, lateral members 29 and 30, each extending between an adjacent pair of ends of side members 27 and 28. In addition, a support member or plate 31 may extend longitudinally between mid regions of lateral members 29 and 30, spaced between side members 27 and 28.

Depending from each lateral member 29 and 30 may be a plurality of journal bearings, such as three journal bearings 32 depending from frame member 29 respectively adjacent to rails 15, 16 and 17, and an additional three journal bearings 33 depending from the lateral member 30 at spaced locations therealong adjacent to respective rails 15–17.

A laterally extending, horizontal shaft or axle 35 extends rotatably through and is supported by the several depending journal supports or pillow blocks 32, while a similar laterally extending horizontal shaft or axle 36 extends through and is rotatably supported by the several laterally aligned depending pillow blocks or bearing supports 33. The shaft 35 is provided with a plurality of rolling support elements or wheels 37, which may be suitably keyed to the shaft 35 and spaced apart for respective rolling engagement with rails 15–17. Similarly carried by the shaft 36 may be a plurality of rolling elements or wheels 38, suitably keyed thereto and spaced for respective rolling engagement on rails 15–17. Thus, the depending journal bearings 32, 33, axle shafts 35 and 36, and wheels 37 and 38 combine to define wheeled running gear for rollably supporting the chassis or frame 26 of carriage 25 for movement along the track means 15–17.

The carriage 25 includes rotary roll means 40 located over the carriage frame 26 and extending laterally thereacross for rotation about a generally horizontal, laterally extending axis, as will appear presently in greater detail.

The roll means 40 is mounted by a plurality of laterally spaced, upstanding mounting posts or struts 41, 42 and 43 upstanding, respectively, from the side frame member 27, the plate member 31 and the side frame member 28. A laterally extending, generally horizontal shaft 44 may extend rotatably through and be journaled in upper regions of the mounting posts 41–43 and carry a pair of coaxial supporting cylinders or rolls 45 and 46. The roll 45 may be located between mounting posts 41 and 42, and the roll 46 may be located between mounting posts 42 and 43, and the rolls may be suitably keyed to shaft 44.

As best seen in FIG. 2, the mounting posts 41–43 may each include an expansile and contractile plunger-in-cylinder structure for vertically raising and lowering the elevation of shaft 44 and its rolls 45 and 46.

For example, the mounting post 41 may include an upstanding hollow cylinder 50 suitably fixed to the side frame member 27 and having vertically slidable in the cylinder 50 a piston 51 resiliently urged downwardly, as by a coil compression spring 52 interposed between the upper side of piston 51 and the upper end of the cylinder 50. Adjacent to the lower end of cylinder 50 there may be provided a hydraulic fluid conduit 53 connected to the interior of the cylinder, and suitable vent means may be provided as required, say through the upper end of the cylinder. A piston rod or shank 54 may project from the piston 51 slidably upwardly through and beyond the upper end of cylinder 50, carrying at its upper end a telescopically extensile cap or journal bearing support member 55 rotatably supporting an adjacent portion of shaft 44. Obviously, fluid under pressure through conduit 53 into cylinder 50 will raise piston 51 and also the shaft supporting element 55, while a release of fluid pressure will permit downward movement of the shaft and piston upon exit of fluid from the cylinder.

A similar vertically extensile and retractile, fluid-actuated mounting structure may be employed at mounting members 42 and 43, so that repeated detail description is not necessary. Of course, the several vertically extensile and retractile mounting elements 41–43 may be simultaneously or sequentially actuated, as desired.

Extending longitudinally along and spaced over the track means 15–17 is a flexible belt or web 60, say having its opposite ends anchored, as by securement means 51 and 52, to opposite ends of the track means 15–17. That is, the track means 15–17 may have rigidly upstanding opposite end members, see FIG. 3, say having stop means or bumpers 65 and 66 for limiting abutting engagement with the carriage 25. The belt or web anchors 61 and 62 may be respectively carried by the upstanding track end structures 63 and 64.

Thus, the carriage 25 is interposed vertically between the upper belt or web 60 and the lower track means 15–17, being ridable along the latter and having the upper roll means 45, 46 engaging the adjacent under portion of the belt or web 60. As the belt, web or mat 60 is of a flexible materal, such as rubber or of similar characteristics, the engaged portion is flexed upwardly, as at 67, to simulate a wave crest, the web portions adjacent to the engaged portion 67 combining with the latter to define the leading and trailing slopes of a wave, as at 68 and 69 in FIG. 3 if the carriage 25 is moving rightward.

That is, movement of carriage 25 along track means 15–16 in its upwardly flexing engagement with the underside of web 60 serves to effect a wave action traveling along the course of the track means. Of course, vertical movement of roll means 45, 46 as by fluid actuation of mounting means 41–43 effects variation in wave amplitude.

Mounted on the platform or plate 31 may be a motive element or motor, as at 70, which may be electrically powered, as by conductors 71. The motive means and powering thereof are shown for purposes of illustration and without limiting intent, other suitable propulsion means being usable, if desired.

The conductors 71 may pass downwardly through plate 31 for electrical contact therebelow with a supply conductor, bus-bar or third-rail 72, see FIG. 2, extending longitudinally along the track means 15–17 and enclosed in a laterally opening protective enclosure 73. Thus, the motor 70 is movable along the track means 15–17 and adapted to be energized at all times by conductor 71 making contact with the third-rail 72.

The motor 70 may include a drive shaft 75 carrying pulleys 76 and 77. A roll means pulley 78 is carried by roll means shaft 44 and a drive belt 79 is trained over motor drive pulley 76 and roll means pulley 78 to effect rotation of the rolls 45 and 46 upon rotation of motor shaft 75. The wheel axles 35 and 36 are respectively provided with pulleys 80 and 81; and, a drive belt 82 is trained over pulleys 77, 80 and 81 to effect rotation of carriage wheels 37 and 38 upon operation of motor 70. In this manner, carriage 25 is caused to move along track means 15–17 and simultaneously is roll means 40 caused to rollingly engage the underside of web 60 while upwardly flexing the latter. Of course, the carriage means may be reversed in direction by reversing the rotation of motor 70.

The operation of roll mounting members 41–43 by fluid operating means may be understood by reference to FIG. 4. It will there be seen that motor 70 may be connected through a clutch 85, operated by a solenoid 86 to a fluid pump 87. The pump 87 may discharge through a fluid conduit 88 to the mounting means supply conduit 53. Also connected to the conduit 53 is a return conduit 89 which is connected through a valve 90 operated by a solenoid 91 to a supply reservoir or sump 92, the latter being connected to the low pressure side of pump 87 for supplying the same.

Hence, operation of solenoid 86 will effect the supply of high pressure fluid to mounting structures 41–43 for elevating the same and raising the wave crest 67, while operation of solenoid 91 to open valve 90 will release fluid pressure in the mounting devices for lowering the same. As the pulley 78 effecting rotation of rolls 45 and 46 travels vertically with the rolls, suitable resiliently biased idler means, such as an idler pulley 93 may be mounted to take up slack in belt 79 upon lowering of the roll means.

While the wave travel longitudinally of track means 15–17, and the variation in wave elevation effected by vertical movement of roll means 40 may be selectively controlled by suitable manual means, it is, of course, appreciated that automatic control means may be employed, including computer-operated control means so that variations may not be readily anticipated by users.

Of course, it will be appreciated by those versed in the arts of surfing and skateboarding that one may ride along the forward slope of a wave in the manner accurately simulating that of actual water surfing conditions.

From the foregoing it is seen that the present invention provides a wave producing apparatus which is extremely simple in construction, well adapted for economic manufacture, installation, maintenance and use, capable of infinite variation in wave motion, and which otherwise fully accomplishes its intended objects.

Although the present invention has been described in some detail by way of illustration and example for purposes of clarity of understanding, it is understood that certain changes and modifications may be made within the spirit of the invention.

What is claimed is:

1. Apparatus for producing wave movement, said apparatus comprising: track means extending generally along a path of wave travel, a flexible web extending longitudinally of said track means, carriage means movable along said track means and engaging an under portion of said web to upwardly flex the engaged web portion, and propulsion for effecting carriage movement along said track means relative to and in upward flexing engagement with said web, whereby said engaged web portion is caused to move and produce a traveling wave.

2. Apparatus according to claim 1, said carriage means including rotary roll means at an upper carriage region for rolling engagement with said web.

3. Apparatus according to claim 2, in combination with roll mounting means mounting said roll means for up and down movement to vary the height of said upward flexed and traveling wave.

4. Apparatus according to claim 3, in combination with control means for controlling said mounting means independently of said propulsion means.

5. Apparatus according to claim 1, said web being spaced over said track means, and said carriage being interposed between said track means and web.

6. Apparatus according to claim 5, said carriage means including wheeled running gear running on said track means, and said propulsion means comprising drive means operatively associated with said running gear.

7. Apparatus according to claim 6, said carriage means including rotary roll means at an upper carriage region for rolling engagement with said web, roll mounting means mounting said roll means for up and down movement to vary the height of upward flexure, and control means for controlling said mounting means independently of said propulsion means.

* * * * *